US006854270B2

(12) United States Patent
Zenker et al.

(10) Patent No.: US 6,854,270 B2
(45) Date of Patent: Feb. 15, 2005

(54) HYDRAULIC VALVE SYSTEM

(75) Inventors: Siegfried Zenker, Kirchseeon (DE); Thorkild Christensen, Sonderborg (DK)

(73) Assignee: Sauer-Danfoss ApS (DK)

( * ) Notice: Subject to any disclaimer, the term of this patent is extended or adjusted under 35 U.S.C. 154(b) by 70 days.

(21) Appl. No.: 10/420,157

(22) Filed: Apr. 22, 2003

(65) Prior Publication Data

US 2003/0205128 A1 Nov. 6, 2003

(30) Foreign Application Priority Data

May 2, 2002 (DE) ..... 102 19 717

(51) Int. Cl.[7] ..... F15B 11/02
(52) U.S. Cl. ..... 60/422; 60/426; 91/446
(58) Field of Search ..... 60/422, 426; 91/446, 91/447

(56) References Cited

U.S. PATENT DOCUMENTS

| | | | | |
|---|---|---|---|---|
| 4,693,272 A | | 9/1987 | Wilke | |
| 4,787,294 A | | 11/1988 | Bowden | |
| 5,138,837 A | | 8/1992 | Obertrifter et al. | |
| 5,315,826 A | | 5/1994 | Hirata et al. | |
| 5,715,865 A | | 2/1998 | Wilke | |
| 6,082,106 A | * | 7/2000 | Hamamoto | 60/422 |
| 6,267,141 B1 | | 7/2001 | Rivolier | |
| 6,318,079 B1 | | 11/2001 | Barber | |

FOREIGN PATENT DOCUMENTS

| | | |
|---|---|---|
| DE | 19640103 C2 | 4/1998 |
| DE | 19919015 A1 | 1/2001 |
| DE | 10033757 A1 | 1/2002 |
| EP | 0877975 B1 | 11/1998 |

* cited by examiner

*Primary Examiner*—Thomas E. Lazo

(57) ABSTRACT

A hydraulic valve system (1) has a supply connection arrangement having a high-pressure connection (P) and a low-pressure connection (T), a working connection arrangement, having two working connections (A, B) connectable with a motor (2), with a directional valve (4), which is arranged between the supply connection arrangement (P, T) and the working connection arrangement (A, B), and with a compensation valve (8), which is acted upon in a first operation direction by a spring (22) and a pressure in a pressure chamber (23), which is connected with a load-sensing line (LS), and in a second operation direction, which is opposite to the first operation direction, by a pressure at the directional valve (4).

8 Claims, 2 Drawing Sheets

HYDRAULIC VALVE SYSTEM

BACKGROUND OF THE INVENTION

The invention concerns a hydraulic valve system with a supply connection arrangement having a high-pressure connection and a low-pressure connection, a working connection arrangement, having two working connections connectable with a motor, with a directional valve, which is arranged between the supply connection arrangement and the working connection arrangement, and with a compensation valve, which is acted upon in a first operation direction by a spring and a pressure in a pressure chamber, which is connected with a load-sensing line, and in a second operation direction, which is opposite to the first operation direction, by a pressure at the directional valve.

A valve system of this kind is known from, for example, DE 199 19 015 A1.

A valve system of this kind is required for controlling a motor. In a hydraulically controlled working machine, such a motor is, for example, able to lift or lower a load. Such a valve system is particularly suited for controlling the hydraulic piston-cylinder systems of a backhoe, said systems being required to align or lower a backhoe arm, or to change the inclination of the arm, on which the bucket is fixed, in relation to the backhoe arm.

By means of the directional valve, the direction of the hydraulic fluid is controlled, in such a way that from the high-pressure connection it reaches one working connection or the other working connection. The compensation valve serves the purpose of maintaining the pressure difference over the directional valve as constant as possible.

Problematic with such a valve system are cases, in which the motor that is supplied with hydraulic fluid via the working connections, is driven from the outside, for example when having to lower a load, or when the motor swings a backhoe uppercarriage with boom. Particularly in the latter case, the high mass inertia may cause the motor to require more fluid than the valve system can provide. The proportional valve is set at a certain flow value, for example 40 liters. The load to be moved is then strongly pushed and starts moving, for example turning. Due to the mass inertia, it can have such a large swing that it travels ahead of the supplied fluid volume, that is, the sufficient amount of oil is no longer supplied. Eventually, the mass gets slower, and has a driving effect, that is, the motor acts as a pump. After a certain time, the mass is slow enough, so that the fluid is again sufficient, and drives the motor. This causes oscillations. Such an oscillation inclination is undesirable.

SUMMARY OF THE INVENTION

The invention is based on the task of reducing such oscillation inclination.

With a hydraulic valve system as mentioned above, this task of reducing oscillation inclination is solved in that the compensation valve has an opening-influencing device.

Thus, the pressures ruling in the load-sensing line or at the directional valve, respectively, no longer exclusively and immediately control the compensation valve. Between them is arranged an opening influencing device, which additionally acts upon the compensation valve, particularly controlling an opening movement in a predetermined manner. In this way it is prevented that the compensation valve is suddenly opened, which could lead to the unfavourable conditions described above. When the opening movement of the compensation valve can be controlled intentionally, then also the movement controlled by the motor, which is connected to the working connections, can be controlled accordingly. This movement control of the load in fact enables a relatively good reduction of the oscillation inclination.

The opening-influencing device produces a ramp-like opening course of the compensation valve. In other words, the compensation is moved over the time in such a way that an ever-increasing opening occurs, or an ever-increasing amount of oil is let through, respectively. However, a stepwise or jumping increase of the oil amount is avoided. The inclination of the ramp depends on the pressures acting in both operating directions of the compensation valve. When the pressure difference is large, the ramp is steeper, that is, the increase in the oil amount flowing through the compensation valve is heavier than in a case, in which, in the operating direction, the pressure difference over the compensation valve is smaller. At any rate, it is ensured that the increase in the oil amount flowing through the compensation valve is controlled.

The opening-influencing device is made as a passive device. Thus, no active control measures from the outside are required to act upon the slide or another valve element of the compensation valve. On the contrary, the opening-influencing device works statically, that is, with motionless parts. This reduces the risk of errors.

Also, the pressure chamber is connected with the load-sensing line via a throttle. Fluid that is displaced from the pressure chamber of the compensation valve thus has to flow through the throttle. The throttle limits the exhaust flow velocity of the fluid from the pressure chamber. Thus, at the same time, the movement speed of the slide (or another valve element) of the compensation valve is limited, resulting automatically in the opening influencing described above. Thus, the throttle acts as an opening-influencing device.

Further, in the flow direction, the compensation valve is arranged between the supply connection arrangement and the working connection arrangement behind the directional valve. This embodiment has the advantage that a "flow sharing" can be achieved, that is, a distribution of the hydraulic fluid on several valve systems arranged in parallel, which are supplied commonly, each supplying their own motors, when the supplied amount is not sufficient. In this connection, the compensation valve is supplied with the highest load pressure occurring in any of the valve systems.

In addition, the compensation valve has an outlet, which is connected with a third inlet of the directional valve, a first inlet of the directional valve being connected with the high-pressure connection and a second inlet of the directional valve being connected with the low-pressure connection. The directional valve can then be operated in the same manner in both directions for the supply of the compensation valve. The directional control itself then occurs via the third inlet of the directional valve.

Also, a first non-return valve, opening in the direction of the load-sensing line, is arranged between the outlet and the load-sensing line. This first non-return valve enables a pressure at the outlet, which is higher than the pressure in the load-sensing line, to be transferred to the load-sensing line. As the load-sensing line controls a pump, which supplies the high-pressure connection, this makes it possible to report the actual pressure demand to the pump, when this demand is higher at the outlet than in another part of the system. On the other hand, it is avoided by means of the non-return valve that the effects of a higher pressure in the load-sensing line get through to the third inlet of the directional valve.

A second non-return valve, opening in the direction of the pressure chamber, is arranged between the outlet and a line section between the pressure chamber and the throttle. This second non-return valve serves the purpose of enabling a fast closing of the compensation valve, when the pressure at the outlet increases too heavily. When only the first non-return valve would be used, the fluid moving the compensation back to the closed position would also flow via the throttle, which might cause a certain slowing-down of the closing process.

The compensation valve has a slide, in which the second non-return valve is arranged. This simplifies the design. No additional space is required for the second non-return valve.

DESCRIPTION OF THE PREFERRED EMBODIMENT

Figure 1:
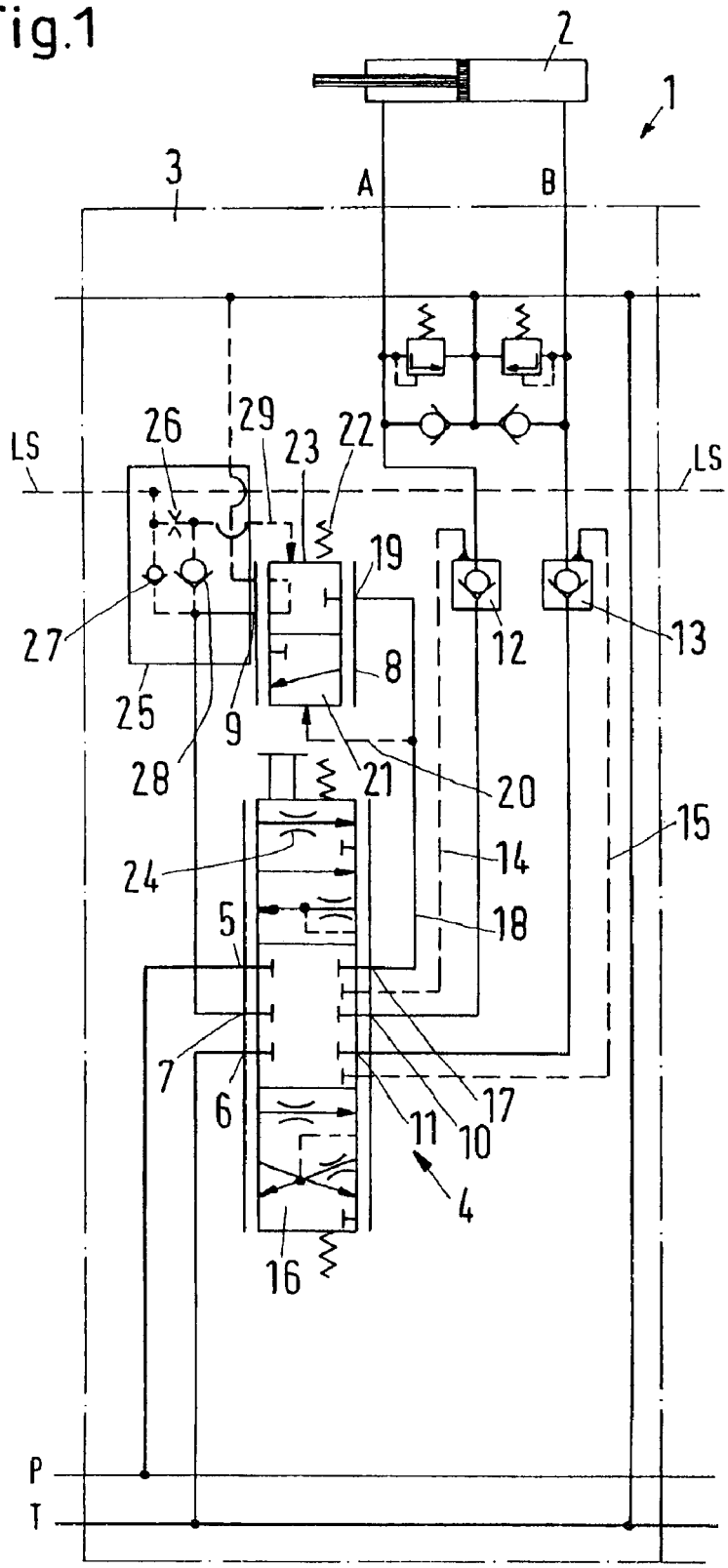
FIG. 1 is a schematic drawing of a valve system of this invention.

With reference to FIG. 1, a hydraulic valve system 1 for controlling a motor 2, in the present case in the form of a piston-cylinder arrangement, has a high-pressure connection P and a low-pressure connection T. Together, the high-pressure connection P and the low-pressure connection T form a supply connection arrangement, through which hydraulic fluid under pressure can flow from a pump (not shown in detail) to the valve system 1 and from here back to a tank (also not shown in detail). The valve system 1 is made as the module 3, which can be flanged together with other modules. Accordingly, the supply connection arrangement can also be connected with the supply connection arrangement of other modules.

The valve system 1 also has a working connection arrangement A, B, to which the motor 2 is connected. Between the supply connection arrangement P, T and the working connection arrangement A, B is arranged a directional valve 4, which supplies either the working connection A or the working connection B with fluid under pressure, that is, connects the corresponding working connection A, B with the high-pressure connection P.

The directional valve has three inlets. A first inlet 5 is connected with the high-pressure connection. A second inlet 6 is connected with the low-pressure connection. A third inlet 7 is connected with a compensation valve 8, or rather with its outlet 9.

The directional valve 4 has a first outlet 10, which is connected with a working connection A, and a second outlet 11, which is connected with the other working connection B. In the lines between the outlets 10, 11 and the working connections A, B are arranged non-return valves 12, 13, which can be opened via auxiliary lines 14, 15 in dependence of the position of the slide 16 of the directional valve 4.

A third outlet 17 is connected with an inlet 19 of the compensation valve 8 via a line 18. A control line 20 branches off from the line 18, said control line 20 ending at a front side of the slide 21 of the compensation valve 8.

On the opposite side, the slide is loaded by a spring 22. In the same direction acts the pressure in a pressure chamber 23, which is connected with a load-sensing line LS.

Thus, in a first operating direction the force of the spring 22 and the pressure in the pressure chamber 23 act upon the slide 21. In the second operating direction, which is opposite to the first operating direction, acts the pressure in the line 18, that is, the pressure at the pressure connection P reduced by a pressure loss at a throttle 24 in the slide 16 of the directional valve 4.

However, the pressure chamber 23 is not connected direct with the load-sensing line LS. Used is an opening influencing device 25, which has a throttle 26 in the line between the pressure chamber 23 and the load-sensing line LS.

The outlet 9 of the compensation valve 8, which is connected with the third inlet 7 of the directional valve 4, is connected with the load-sensing line LS via a first non-return valve 27, the non-return valve 27 opening in the direction of the load-sensing line LS. Further, a second non-return valve 28 is provided, which connects the outlet 9 of the compensation valve 8 with a line section 29 between the pressure chamber 23 and the throttle 26.

When the compensation valve 8 is moved from the shown, closed position of the slide 21, in which the outlet 9 is connected with the tank connection T, to its open position, in which the inlet 19 is connected with the outlet 9 of the compensation valve, the opening movement is influenced by the fact that the fluid flowing off from the pressure chamber 23 must flow through the throttle 26. The non-return valves 27, 28, block other ways. Thus, the throttle 26 limits the speed, with which the slide 21 of the compensation valve 8 can move. At the same time, however, the speed is limited, at which the fluid amount supplied to the motor 2 can increase. This is particularly the case, when an external load drives the motor 2.

On the other hand, a fast return movement of the slide 21 to the closed position is possible, as, with a pressure increase at the outlet 9 of the compensation valve 8, a correspondingly fast pressure increase in the pressure chamber 23 via the second non-return valve 28 is possible.

In principle, the valve system works as follows: When the slide 16 of the directional valve 4 is displaced, the high-pressure connection P will, in both positions, be connected via the first inlet 5 with the third outlet 17 and thus with the inlet 19 of the compensation valve 8. Via the line 20, the compensation valve 8 is opened. Thus, fluid can flow via the outlet 9 and the third inlet 7. The further direction of the fluid depends on the position of the slide 16 of the directional valve 4. When the slide is moved downward, the third inlet 7 is connected with the first outlet 10, and thus with the working connection A. The second inlet 6 is connected with the second outlet 11, that is, the working connection B is connected with the low-pressure connection T. When the slide 16 is moved upward (in relation to the view in FIG. 1) the conditions be vice versa. In any case, the controlled non-return valve 12, 13 in the line, which is connected with the low-pressure connection T, is opened. The pressure in the line to the working connection opens the other non-return valve 13, 12 A, B.

Figure 2:
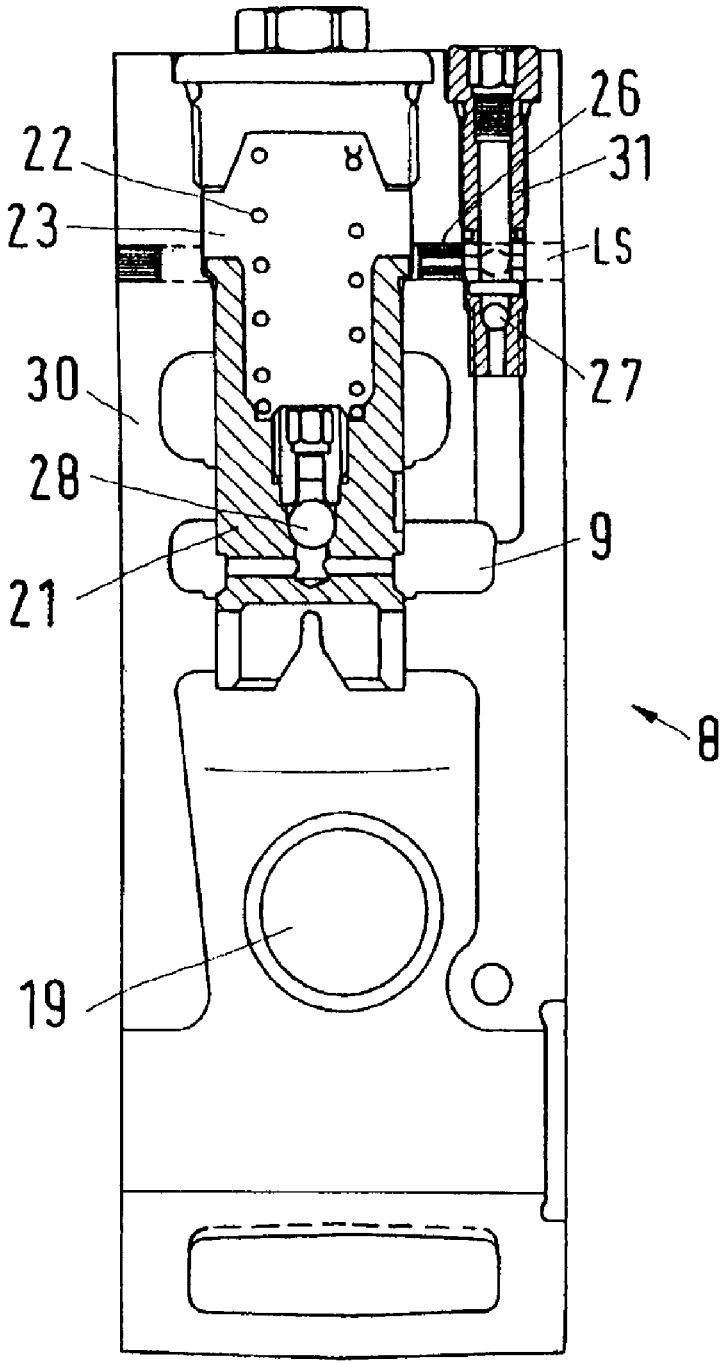
FIG. 2 is a schematic cross-sectional view through the compensation valve of this invention.

FIG. 2 shows a schematic view of the compensation valve 8 with the slide 21, in which the second non-return valve 28 is arranged. The compensation valve 8 has a housing 30, in which the slide 21 is displaceable against the force of the spring 22. The pressure chamber 23, whose pressure acts upon the slide 21, is connected with the load-sensing connection LS via the throttle 26. Via the first non-return valve 27, this connection LS is direct connected with the outlet 9 of the compensation valve 8. Here, the first non-return valve 27 is arranged in an insert 31, which is screwed into the housing 30.

The size of the throttle 26 corresponds to the requirements, that is, the intended loads, which are to be handled.

In certain cases, the second non-return valve 28 can be omitted, namely, when a damping of the movement of the slide 21 of the compensation valve 8 is also desired during the closing movement.

It is therefore seen that this invention will achieve all of its objectives.

What is claimed is:

1. A hydraulic valve system with a supply connection arrangement having a high-pressure connection and a low-pressure connection, a working connection arrangement, having two working connections connectable with a motor, with a directional valve, which is arranged between the supply connection arrangement and the working connection arrangement, and with a compensation valve, which is acted upon in a first operation direction by a spring and a pressure in a pressure chamber, which is connected with a load-sensing line, and in a second operation direction, which is opposite to the first operation direction, by a pressure at the directional valve, characterized in that the compensation valve (8) has an opening influencing device (25); and that the pressure chamber (23) is connected with the load sensing line LS via a throttle (26).

2. A valve system according to claim 1, characterized in that the opening influencing device (25) produces a ramp-like opening course of the compensation valve (8).

3. A valve system according to claim 1, characterized in that the opening influencing device (25) is made as a passive device.

4. A valve system according to claim 1, characterized in that in the flow direction, the compensation valve (8) is arranged between the supply connection arrangement (P, T) and the working connection arrangement (A, B9 behind the directional valve (4).

5. A valve system according to claim 4, characterized in that the compensation valve (8) has an outlet (9), which is connected with a third inlet (7) of the directional valve (4), a first inlet (5) of the directional valve (4) being connected with the high-pressure connection (P) and a second inlet (6) of the directional valve (4) being connected with the low-pressure connection (T).

6. A valve system according to claim 5, characterized in that a first non-return valve (27), opening in the direction of the load-sensing line (LS), is arranged between the outlet (9) and the load-sensing line (LS).

7. A valve system according to claim 5, characterized in that a second non-return valve (28), opening in the direction of the pressure chamber (23), is arranged between the outlet (9) and a line section (29) between the pressure chamber (23) and the throttle (26).

8. A valve system according to claim 7, characterized in that the compensation valve (8) has a slide (21), in which the second non-return valve (28) is arranged.

* * * * *